United States Patent [19]

Ramirez

[11] 4,178,830

[45] Dec. 18, 1979

[54] COMPACT B-FLAT HORN AND CASE THEREFOR

[75] Inventor: Lawrence V. Ramirez, Kenosha, Wis.

[73] Assignee: G. Leblanc Corporation, Kenosha, Wis.

[21] Appl. No.: 833,004

[22] Filed: Sep. 14, 1977

[51] Int. Cl.[2] ..... G10D 7/10

[52] U.S. Cl. ..... 84/388; 84/398

[58] Field of Search ..... 84/387, 388, 389, 395, 84/398, 399

[56] References Cited

U.S. PATENT DOCUMENTS

| | | | |
|---|---|---|---|
| 593,690 | 11/1897 | Richmand . | |
| 1,666,228 | 4/1928 | Wolfe | 84/398 |

FOREIGN PATENT DOCUMENTS

| | | | |
|---|---|---|---|
| 274440 | 11/1966 | Australia | 84/388 |
| 577411 | 9/1924 | France | 84/388 |
| 2017 | of 1858 | United Kingdom | 84/388 |

OTHER PUBLICATIONS

Chris Kratt—Huettl Advertisement

*Primary Examiner*—Lawrence R. Franklin
*Attorney, Agent, or Firm*—Trexler, Wolters, Bushnell & Fosse, Ltd.

[57] ABSTRACT

A Bb brass horn is provided with a bell which is threaded on to the remainder of the instrument. This provides a thickening of the metal at the position of attachment and hence a relatively rigid ring circumferentially about the bell, enhancing the tonality of the instrument. The bell is detachable for storage and carrying in a relatively flat case resembling an attache case, the axis of the bell being perpendicular to the plane of the body of the instrument. The piston valves are positioned centrally of the circle or ring of the instrument for improved balance.

3 Claims, 6 Drawing Figures

COMPACT B-FLAT HORN AND CASE THEREFOR

BACKGROUND OF THE INVENTION

For a great many years brass horns, such as French horn, mellophone, fluegelhorn and baritone horn have had flared, integral bells of rather large diameter. The sounds produced have been rather bright, and the large diameter of the bell has required an ungainly and unsightly carrying case which has been difficult to carry about, and which has been prone to tip over when in the rest position.

OBJECTS AND ADVANTAGES OF THE PRESENT INVENTION

A principle object of the present invention is to provide a brass horn of improved characteristics. Specifically, it is an object to provide a brass horn having an improved, darker tonality than is conventional but still projecting well. Yet another specific object is to provide a more readily transportable horn.

The foregoing and other objects are attained by the provision of a horn having a flared bell which is screw threadedly mounted to the remainder of the instrument well along the flare. Additional bands of heavy metal are provided for the screw threads, and this changes the resonance characteristics of the horn, thereby providing the desired darker tonal quality. Removal of the horn permits it to be turned at right angles whereby the entire instrument is readily carried in a substantially flat case resembling an attache case. Positioning of the horn relative to the balance of the instrument provides enhanced visibility for the player, while placement of the piston valves centrally of the circle of the instrument enhances balance.

BRIEF DESCRIPTIONS OF THE DRAWINGS

The invention will best be understood with reference to the following description when taken in connection with the accompanying drawings wherein.

DETAILED DISCLOSURE

Figure 1:
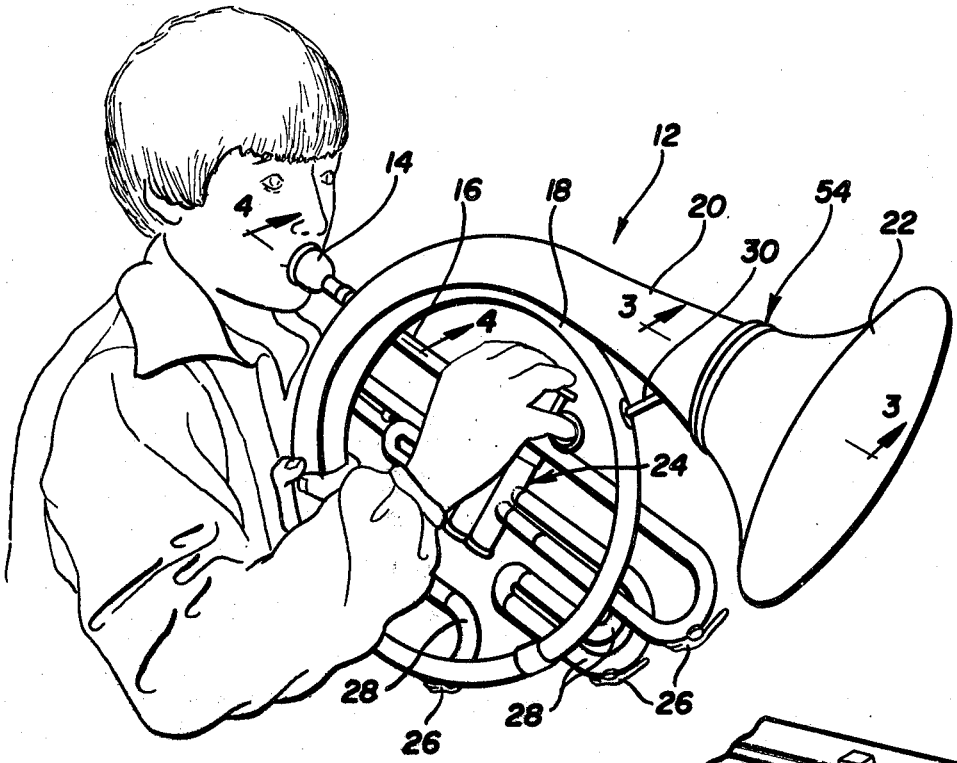
FIG. 1 is a perspective view of a horn as constructed in accordance with the present invention.

Referring now in greater particularity to the drawings, and first to FIG. 1, there is shown a compact Bb horn 12 constructed in accordance with the present invention. The horn is provided with a mouthpiece 14 detachably connected to an upper tubing section 16, the tubing subsequently looping or zigzagging back and forth, and terminating in a circle or loop 18 leading to a flare 20 having a bell 22. The flare and bell are similar to those of a French horn. The tubing 16 is provided with 3 piston valves of generally conventional configuration, but disposed substantially centrally of the loop or circle 18 for improved balance. The instrument is provided with the usual spring closed valves 26 for expelling water from the instrument, and is also provided with appropriate tuning slides as at 28. The forward portion of the flare 20 is provided with a brace 30. An additional brace 32 is provided adjacent the bottom portion of the instrument.

Figure 3:
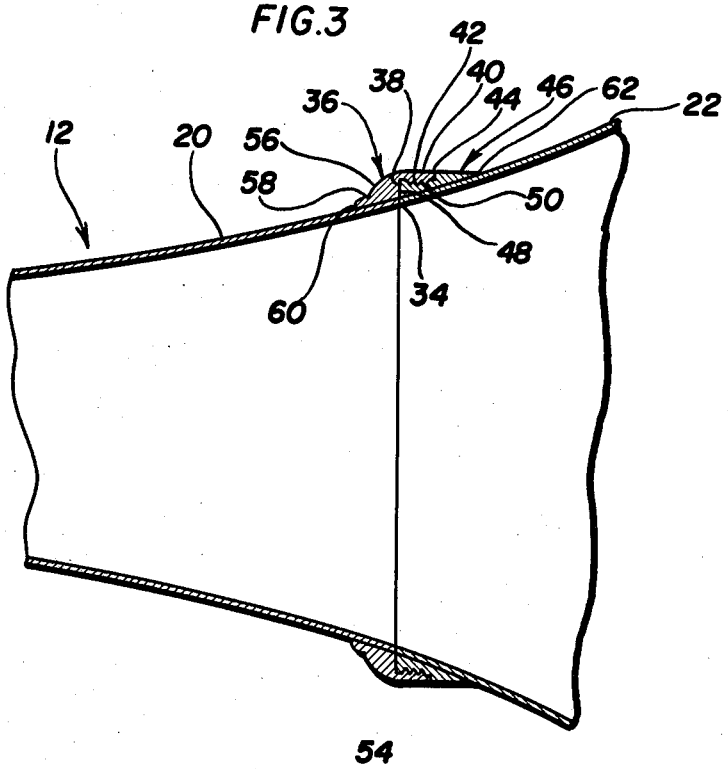
FIG. 3 is a fragmentary longitudinal view on an enlarged scale as taken substantially along the lines 3—3 in FIG. 1.

Referring now in greater particularity to FIG. 3, the bell 22 of the horn is separated from the flare 20 on a parting line 34. This may be effected by fabricating the flare and the bell as two separate parts, or by fabricating them as a single part, and subsequently cutting the bell from the flare. As will be understood, the entire horn, and particularly the flare and bell are made of known or suitable materials, brass being a common example.

A ring 36 of brass or other suitable or compatible material is secured to the outside of the end of the flare 20, having an internal seat 38 at right angles to the axis of the flare. A circumferential flange 40 extends forwardly therefrom and is provided with female threads 42. The flange ends at a right angle surface 44.

As a complement thereto the rear end of the bell 22 is provided with a circumferential ring 46 of brass or the like, soldered or brazed in place, the same as the ring 36. This ring is provided with a right angle end surface 48 which will seat against the shoulder or set 38 of the ring 36. The ring 46 further is provided with male threads 50 which mate with the female threads 42. A right angle shoulder or seat 52 is provided at the axial depth of the threads 50, the surface 44 seating thereagainst. The two rings 36 and 46 threaded together form a composite separable ring 54 which is of approximately ten times the thickness of the sheet metal of the flare and bell. This provides dampening to the flare and bell, and provides a darker color to the horn, somewhat similar but more reliable than the placing of the player's hand within the bell of a French horn, sometimes done in displaying of the French horn. This is probably due to change of the resonance characteristics of the flare and bell by the rigidifying affect of the ring.

Before leaving the ring 54, it will be seen particularly in FIG. 3 that the flare ring 36 has a curved axial section 56 with an indentation 58 and a shoulder 60.

Reference was made to the fact that the effect of the ring on the horn is somewhat similar to that of a hand placed in the French horn bell. It should be noted that such placement of hand interferes with projection from the instrument, which projection is greatly enhanced in the present horn.

In normal playing position the piston valves would be held in vertical position with the adjacent tubing horizontal. The axis of the flare and bell is parallel to this tubing, and thus would also be horizontal. In this position the bell is high enough, and of small enough external dimension, that the player can look below the bell to see sheet music on a stand or if marching, the area in front of him.

As to such dimensions, in one actual specimen, the outside diameter of the bell is about 9". The small end of the bell at the parting line 34 is slightly over 3", while the actual length of the bell from the parting line 34 to the extreme end thereof, along the axis, is about 3¼".

Figure 2:
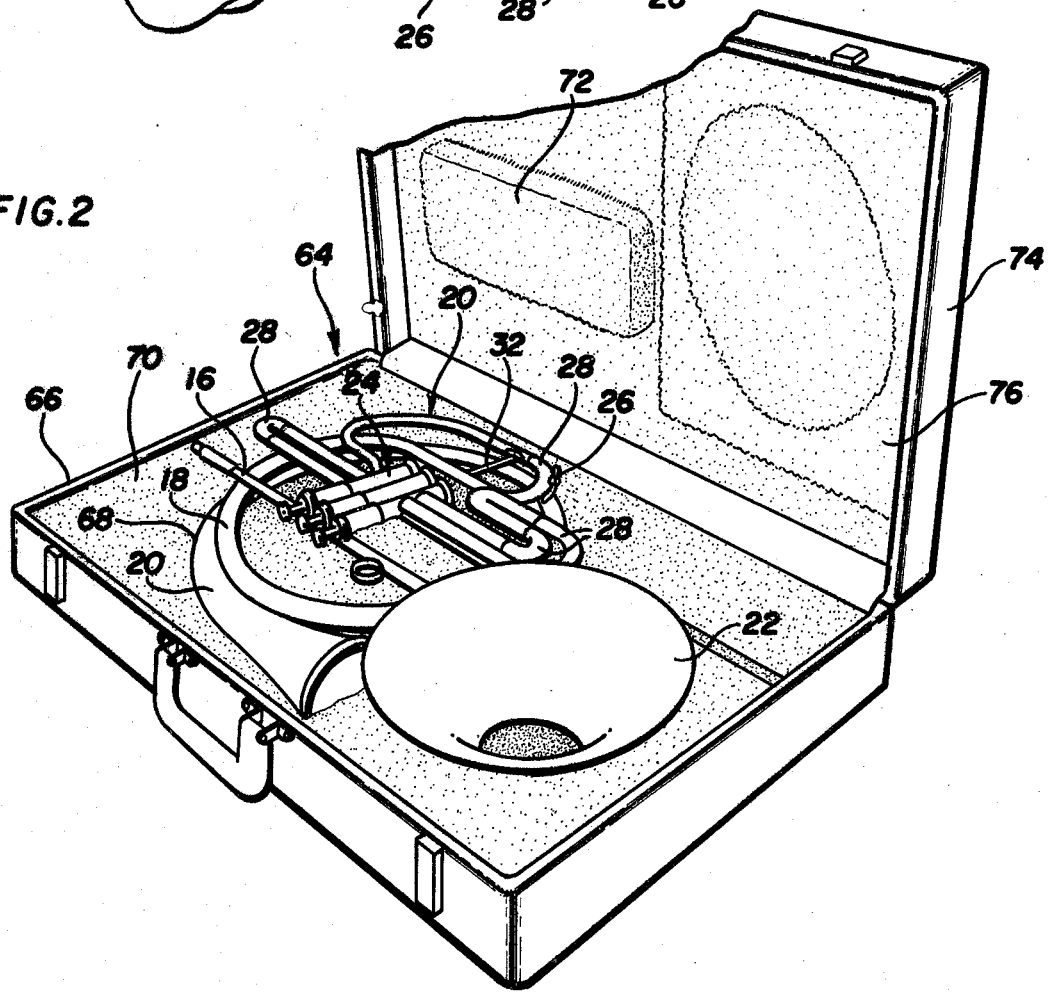
FIG. 2 is a perspective view of the horn as disassembled and placed in its carrying case.

As may be seen with reference to FIG. 2 the disassembled horn 22 stores readily in a flat case resembling an attache case. The case is approximately 20" in length and 16" in height (or front to back dimension as viewed in FIG. 2) being on the order of 5" thick with the lid closed. The case 64 includes a bottom portion 66 having a recess 68 therein in which the main portion of the horn is received with certain portion thereof projecting above the top surface 70, including a portion of the flare, and the piston valves 24 and attached tubing. A resilient protuberance 72 in the top 74 of the case presses lightly against the piston valves to hold the main portion of the horn in place in its recess. An additional, generally frustro conical recess (mostly hidden in FIG. 2) receives the horn bell 22 with the small end down, and the large end thereof projecting above the surface 70. An additional resilient protuberance 76 in the top case portion 74 presses gently against the rim of the horn to hold it in place in its recess.

The neat, relatively flat case provided is a significant step forward from the unsightly and ungainly shaped case with thick portions as has been common heretofore for storing and carrying horns, such as French horns. The use of a case of this sort is brought about by the novel removability of the horn bell as distinguished from previous practice in which the bell was integral with the flare and the remainder of the horn.

Figure 4:
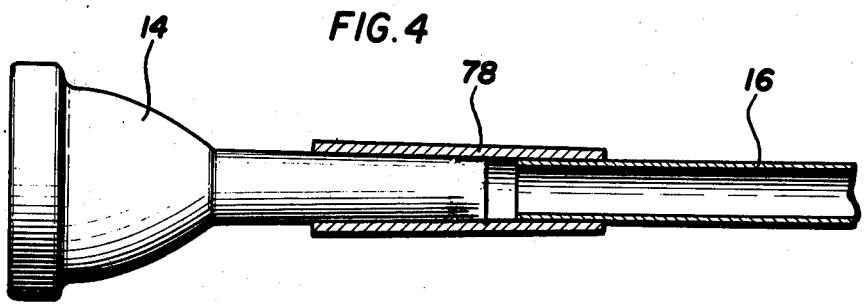
FIGS. 4, 5 and 6 comprise fragmentary longitudinal views through the mouthpiece and adjacent tubing of the horn showing the horn with different types of mouthpieces.
Figure 5:
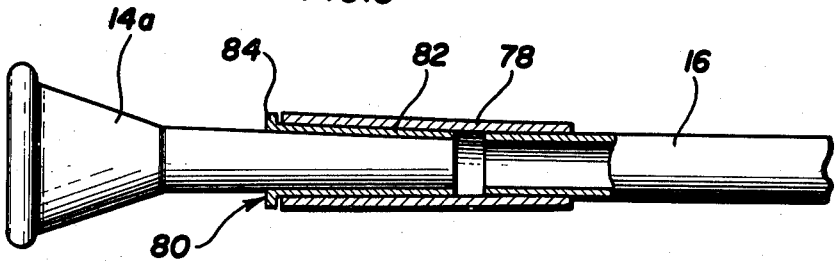

Turning now to FIG. 4, the extreme end of the horn tubing 16 is provided with a tubular mouthpiece receiver 78 of known type, soldered or welded into place. This receiver accepts a trombone mouthpiece 14 as shown in FIG. 1 and FIG. 4, and the tone of the instrument is then much that of a trombone. The tubing end 16 and mouthpiece receiver 78 are again shown in FIG. 5. In this instance a somewhat smaller mouthpiece **14*a* as of a mellophone or alto horn, or flugelhorn is installed. Since this mouthpiece is somewhat smaller an adapter 80 is provided, comprising a cylinder 82 received within the mouthpiece receiver 78, and a peripheral flange 84** limiting insertion and facilitating withdrawal.

It would be well to point out at this time that the mouthpiece receiver 78 is not quite a cylinder, but is somewhat tapered, having a larger receiving or outer end than the inner end. The corresponding part of the mouthpiece 14 is also somewhat tapered, while the adapter 82 in FIG. 5 likewise is somewhat tapered.

Figure 6:
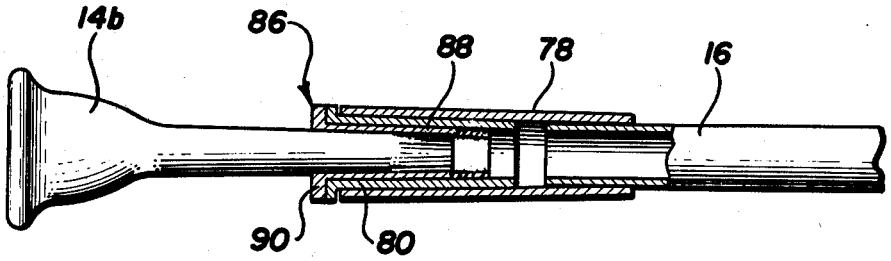

Similar structure is shown in FIG. 6 with an even smaller mouthpiece **14*b*, as of a French horn. In addition to the adapter 80 there is a second slightly smaller adapter 86 having a slightly tapered cylindrical portion 88 received within the adapter 80, and a peripheral flange 90** limiting insertion. The peripheries of both flanges may be serrated for convenience of handling, as well as for appearance purposes.

In each instance the horn takes on some of the coloration of the instrument whose mouthpiece is used, thereby rendering the present horn quite versatile in nature. The tonality is improved, as heretofore indicated, while the separability of the bell leads to a more efficient and a more attractive carrying case. The placement of the piston valve improves balance of the instrument, while the valve placement coupled with the disposition of the flare and bell permits the player readily to look under the bell, as to see sheet music, marching and to see the band director.

An additional benefit of the threaded structure of the present horn resides in strengthening of the bell and flare, thereby resisting dents which are often inflicted in other horns by rather inconsequential bumps.

The specific example of the present invention as herein shown and described, along with the modifications thereof, are exemplary only, and various changes will no doubt be apparent to those skilled in the art, all of which will be understood as forming a part of the present invention insofar as they fall within the spirit and scope of the appended claims.

The invention is claimed as follows:

1. A brass horn comprising convoluted lengths of tubing in laterally close-coupled disposition and having an entering end length of tubing for mouthpiece attachment at one end thereof and an exit end including a tubing loop traversing the tubing convolutions within the maximum extent thereof and merging with a flare having the center axis thereof parallel to and above the longitudinal axis of the entering end length of tubing, a bell with a detachable connection to the end of the flare at a location where the center axis of the bell is coincident with the center axis of the flare and parallel to the longitudinal axis of the entering end length of tubing to open oppositely to an attached mouthpiece giving the player clear vision below the bell to see sheet music or the frontal area if marching, the axial extent of the bell being relatively short to not substantially exceed the transverse extent of the close-coupled tubing and flare for compact case packing when detached, and touch keys for piston valve actuation disposed along the entering end length of tubing below the adjacent tubing loop and flare.

2. A brass horn as set forth in claim 1 and further including in combination therewith a substantially flat case having means therein for supporting said bell and means for supporting the remainder of said horn with the bell axis at right angles to the central plane of the remainder of said horn.

3. A brass horn as set forth in claim 1 wherein the means for detachably securing the bell to the exit end flare comprises a circumferential ring fixed to said flare externally thereof and having male threads thereon, and a complementary ring fixed to said flared bell externally thereof and having female threads engaging said male threads, said rings damping said flare and bell and permitting removal of said bell.

* * * * *